United States Patent [19]

Fedder

[11] Patent Number: 4,976,628

[45] Date of Patent: Dec. 11, 1990

[54] MODULES FOR CABLE ASSEMBLIES

[75] Inventor: James L. Fedder, Etters, Pa.

[73] Assignee: AMP Incorporated, Harrisburg, Pa.

[21] Appl. No.: 430,682

[22] Filed: Nov. 1, 1989

[51] Int. Cl.[5] ..... H01R 4/66

[52] U.S. Cl. ..... 439/101; 439/610

[58] Field of Search ..... 439/101, 497, 608–610

[56] References Cited

U.S. PATENT DOCUMENTS

| | | | |
|---|---|---|---|
| 3,859,724 | 1/1975 | Folkenroth | 29/628 |
| 4,655,515 | 4/1987 | Hamsaer et al. | 439/497 X |
| 4,826,463 | 5/1989 | Lockard | 439/101 |
| 4,846,727 | 7/1989 | Glover et al. | 439/608 |

OTHER PUBLICATIONS

"The Demands of Logic and Power on Backplanes" by Peter Turner and George Black (4–88).

*Primary Examiner*—Eugene F. Desmond

*Attorney, Agent, or Firm*—Allan B. Osborne

[57] ABSTRACT

A module (22) for use on a cable assembly (10) of coaxial conductors (12) is disclosed. The module (22) includes signal pins (42) in a row of passages and a ground element (60) in a recess (94) on one side surface (92) of the module (22). The ground element (60) includes a plate (76) which has a width at least equal to the row of signal pins (42) to maintain signal integrity when more than one module (22) is placed side by side.

1 Claim, 6 Drawing Sheets

Figure 5A
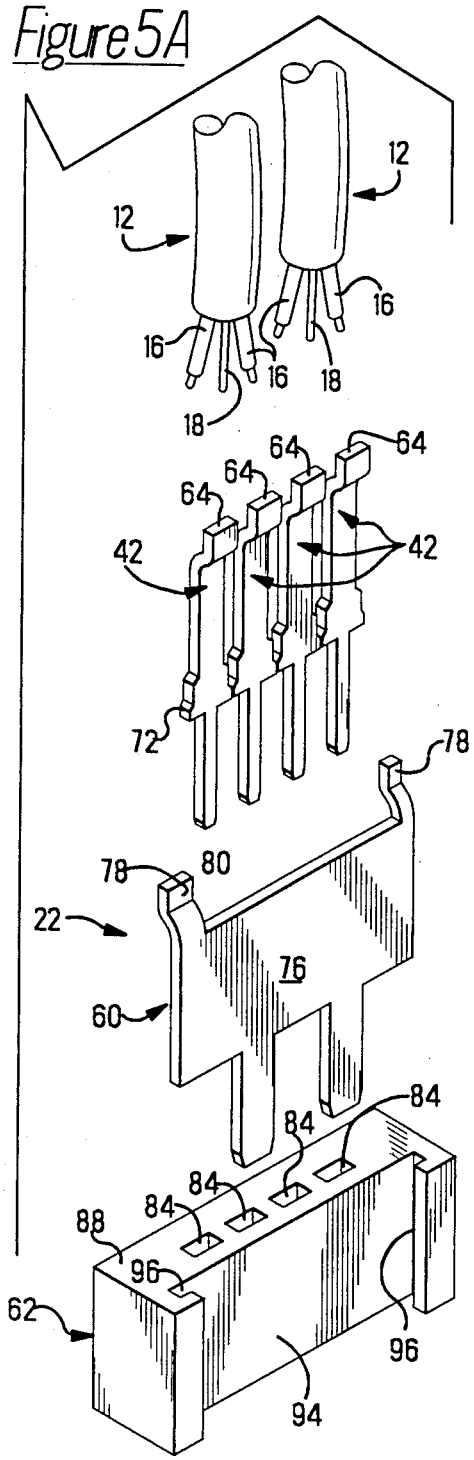
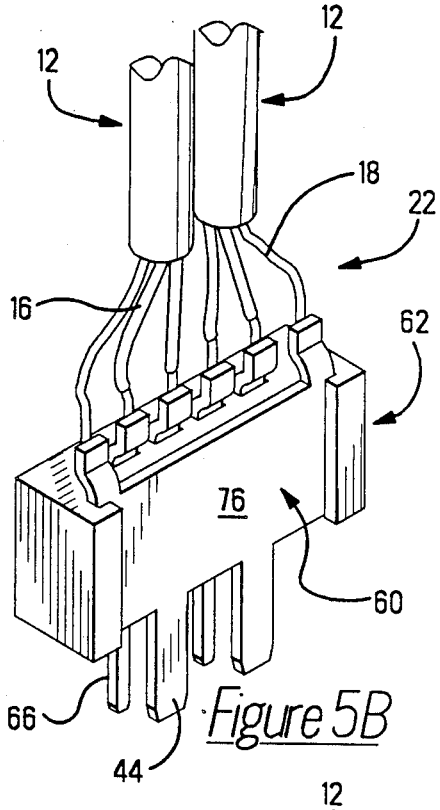
Figure 5B
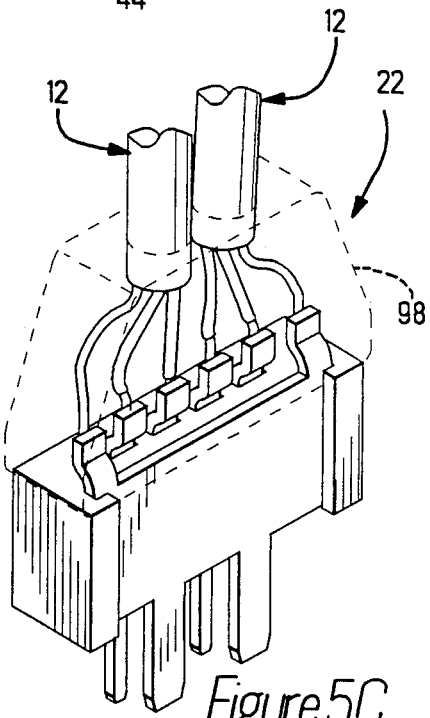
Figure 5C

MODULES FOR CABLE ASSEMBLIES

FIELD OF THE INVENTION

The invention disclosed herein relates to modules for use with a cable assembly for attaching the cable assembly to a connector mounted on a printed circuit board electronic device and in which is incorporated ground elements for maintaining signal integrity.

BACKGROUND OF THE INVENTION

It is well known in the art that high speed digital equipment are faced with special noise problems in the form of crosstalk and ground bounce. These problems require a solution which will maintain signal integrity throughout the system. With respect to two piece, high density connector systems; e.g., the AMP Incorporated high Density TBC Plus connector system, noise problems have been abated by using ground contact elements on at least one side of a row of signal pins. In addition to the TBC Plus connector system, an even more advanced solution is disclosed in U.S. Pat. No. 4,846,727 which has been assigned to AMP Incorporated. That patent teaches the use of conductive plates positioned between adjacent rows of signal pins and electrically connected to ground circuits on the attached back panel and daughter card. This solution requires ground circuits in the back panel which may not be desired in some cases. Further, some designers prefer to route certain signal lines between daughter cards through cable assemblies rather than through the back panel. However contemporary coaxial cable assemblies have not been adapted for direct use with the aforementioned two piece high density connector systems. Accordingly, it is now desirable to provide modules for a cable assembly incorporating ground shields for maintaining signal integrity at the point of connection between the twin axial cable and connector.

SUMMARY OF THE INVENTION

According to the invention, a module for terminating both signal and ground wires of a twin axial conductor is provided. The module includes a block of dielectric material containing a passage therethrough and a recess on one side surface. A signal pin disposed in the passage includes a tab at one end for receiving the signal wire and a post at another end. A ground element includes a plate positioned in the recess, a tab at one edge of the plate to receive the ground wire and a blade at the opposite edge.

BRIEF DESCRIPTION OF THE DRAWINGS

FIGS. 5A, 5B and 5C are views showing the steps in putting the components together to form the module;

DESCRIPTION OF THE INVENTION

Figure 1:
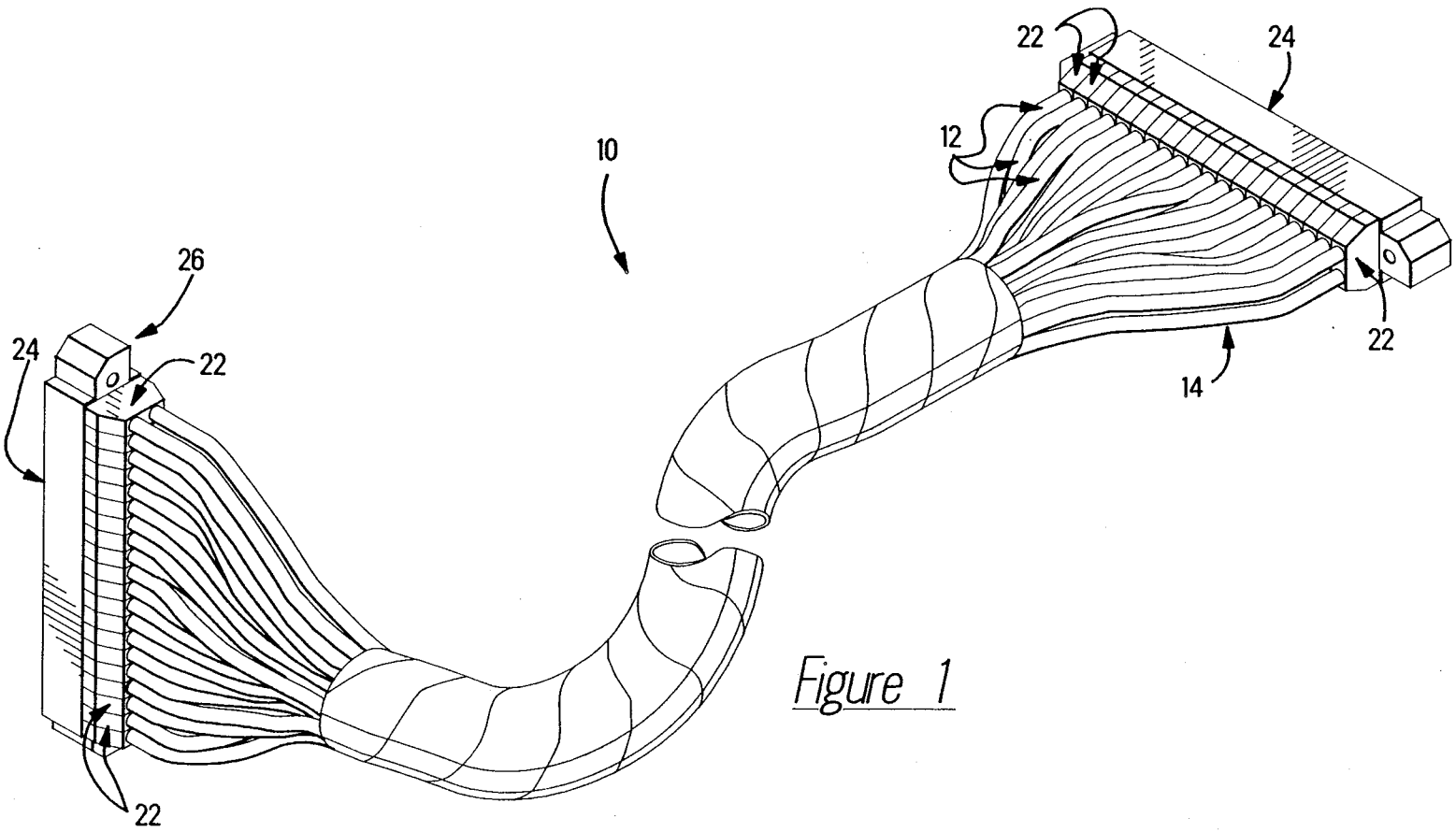
FIG. 1 is a perspective view of a cable assembly incorporating the concepts of the present invention.

Cable assembly 10 shown in FIG. 1 includes a plurality of twin axial conductors 12 forming cable 14. As shown in FIG. 5A, each conductor 12 contains a pair of signal wires 16 and a drain or ground wire 18. Referring back to FIG. 1, pairs of conductors 12 are terminated to respective modules 22 and all the modules 22 at each end of cable 14 are contained in housings 24 to define pin headers 26.

Figure 2:
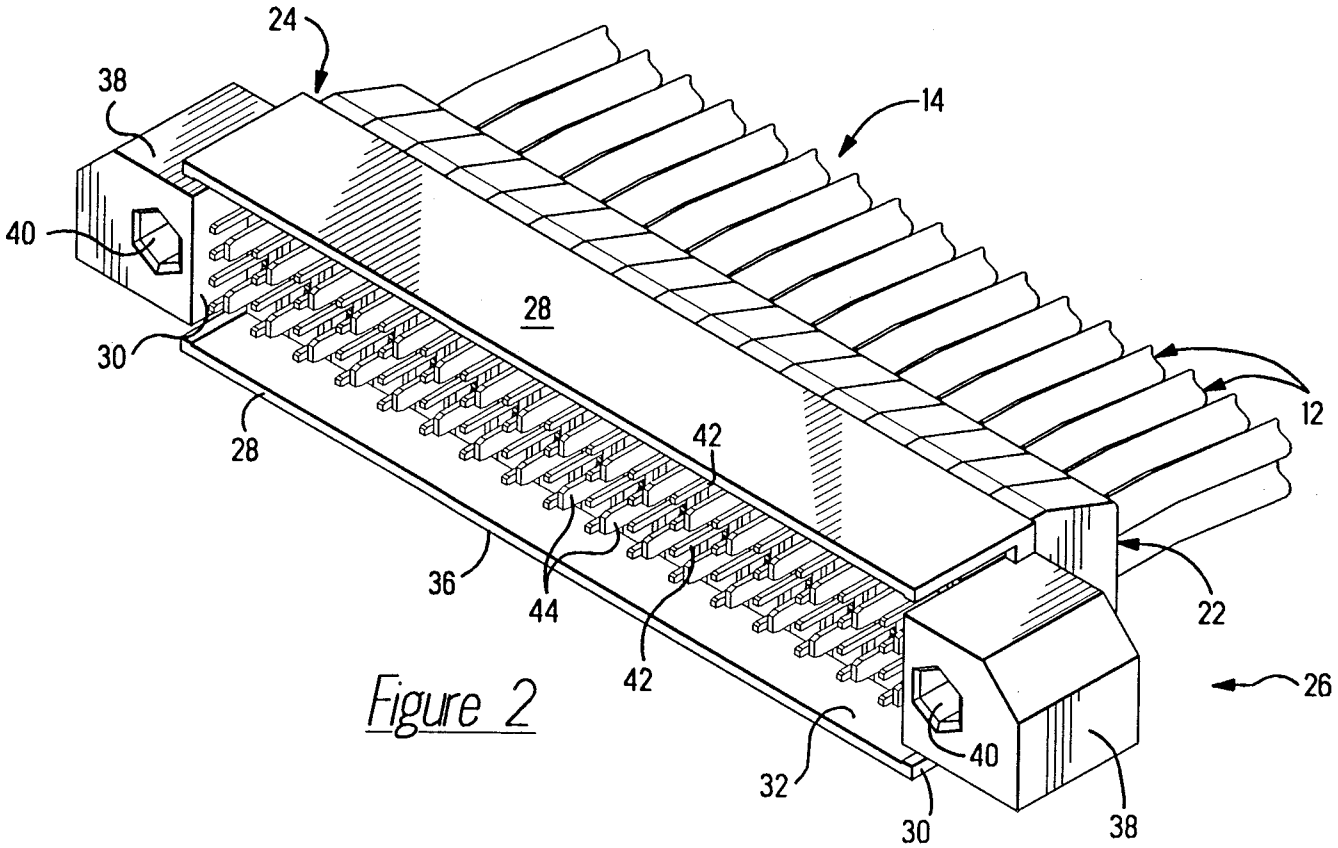
FIG. 2 is a view of one end of the cable assembly.

As shown in FIG. 2, housing 24 includes side walls 28 and end walls 30 which define opening 32 extending therethrough and having a rear face 34 and front face 36. Polarized ears 38, attached to and projecting outwardly from end walls 30, include polarized openings 40 opening outwardly on the housing front face 36. As shown, modules 22 plug into housing 24 from the rear face 34 and with signal pins 42 and ground blades 44 projecting towards front face 36.

Figure 3:
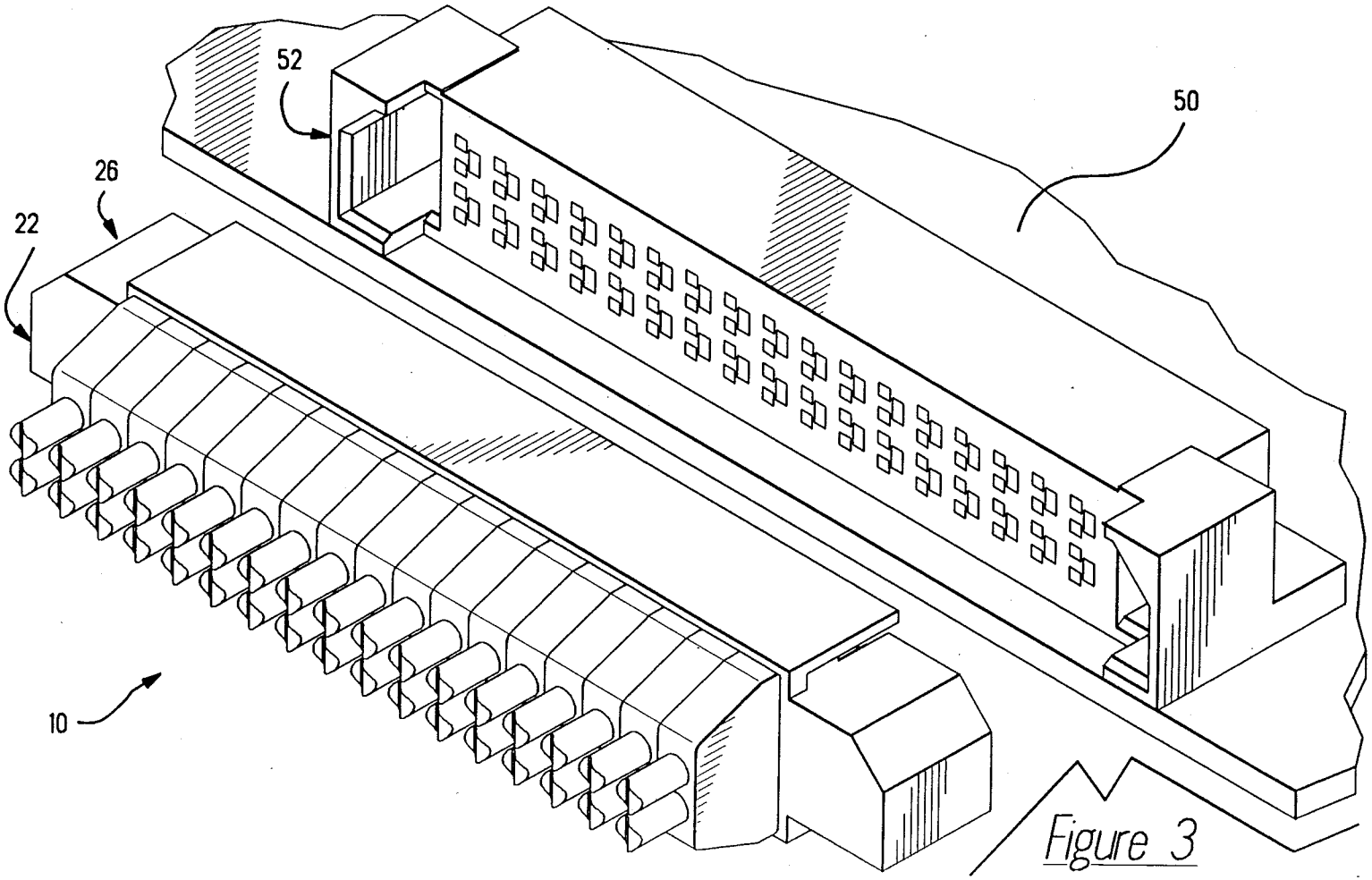
FIG. 3 is a perspective view showing a use of the cable assembly.

FIG. 3 illustrates one use for cable assembly 10 which is providing electrical communications between electronic packages (not shown) on back panel or printed circuit board (PCB) 50 through receptacle 52 to some other electronic device (not shown). Signal pins 42 are received in twin beam contacts or the like (not shown) disposed in respective cavities 54. Ground blades 44 engage ground contacts (not shown) in respective slots (not discernible) in receptacle 52 to maintain signal integrity such as taught in a copending application Ser. No. 07/367,929 filed on June 19, 1989. Receptacle 52 includes leads (not shown) which electrically engage conductive traces (not shown) on PCB 50.

Figure 4:
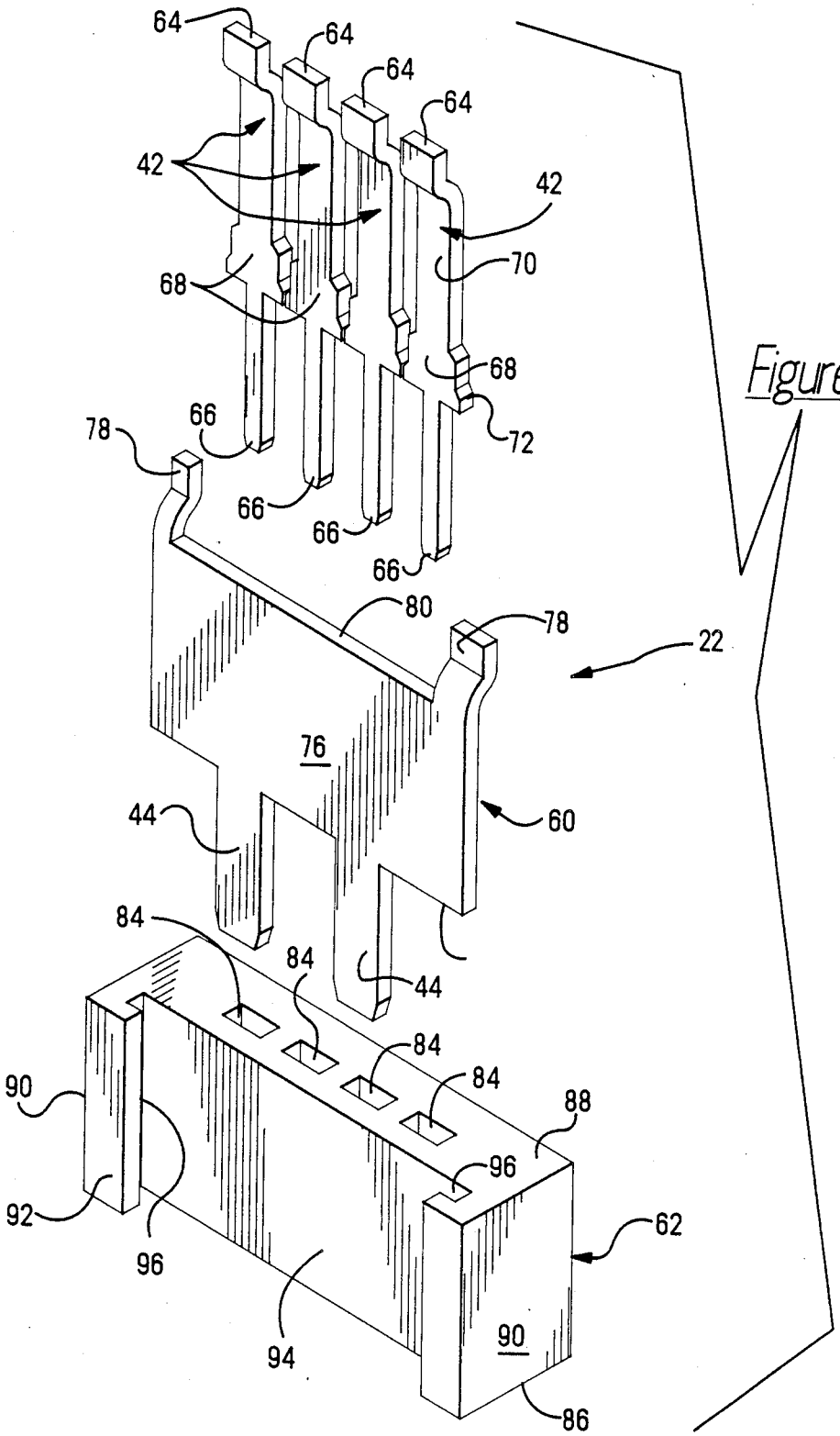
FIG. 4 is a perspective view of the components of a module which forms part of the cable assembly.

FIG. 4 shows three of four components of a module 22. They include four signal pins 42, ground element 60 and retaining block 62. Each signal pin 42 has a wire attaching tab 64 at one end, post 66 at another end, a retention section 68 and connecting strap 70 in between. Tab 64 is parallel to the plane of the pin 42 but offset normal thereto. Post 66 may be square or rectangular in cross section as required. Retention section 68 includes laterally projecting ears 72.

Ground element 60 includes plate 76, wire attaching tabs 78 extending outwardly from each end of rear edge 80 of plate 76 and a pair of the aforementioned blades 44. Blades 44 are attached to and extend forwardly of front edge 82 of plate 76 and are spaced to each side of the plate's center line (not shown). Tabs 78 are offset normally to and parallel with the plane of plate 76.

Pins 42 and element 60 are preferably stamped and formed from phosphor bronze.

Retaining block 62 is provided with a row of four, spaced passages 84 which open onto front and rear surfaces 86,88 respectively. Passages 84 form a row extending between opposing end surface 90 of block 62. Side surface 92 is provided with recess 94 and inwardly facing slot 96 on each side thereof. Block 62 is molded from a suitable plastics material with liquid crystal polymer being one such material.

FIGS. 5A, 5B and 5C show the steps of assembling module 22 including the addition of the final component, hood 98.

As shown in FIG. 5A, assembly beings with signal wires 16 of a pair of conductors 12 being welded to tabs 64 on respective pins 42 and the two ground wires 18 being welded to respective tabs 78 on each side of plate 76 of element 60. Pins 42 and element 60 are then inserted into block 62 from rear surface 88 with pins 42 being received in respective passages 84 and element 60 in recess 94. The pins 42 are held in place by a frictional fit between ears 72 and the passage walls (not shown). Element 60 is retained by a frictional fit in slots 96 on each side of recess 94. FIG. 5B shows block 62 loaded as described above. Note from FIGS. 5A and 5B that pins 42 and element 60 are orientated so that tabs 64 and 78 on pins 42 and plate 76 respectively are on line with each other.

The final step is to add hood 98 which may be a separate molded component or formed directly onto the sub-assembly shown in FIG. 5B by a subsequent molding operation. In any event, hood 98 protects the welded connections between wires 16,18 and pins 42, element 60 respectively as indicated in FIG. 5C.

Figures 6, 7:
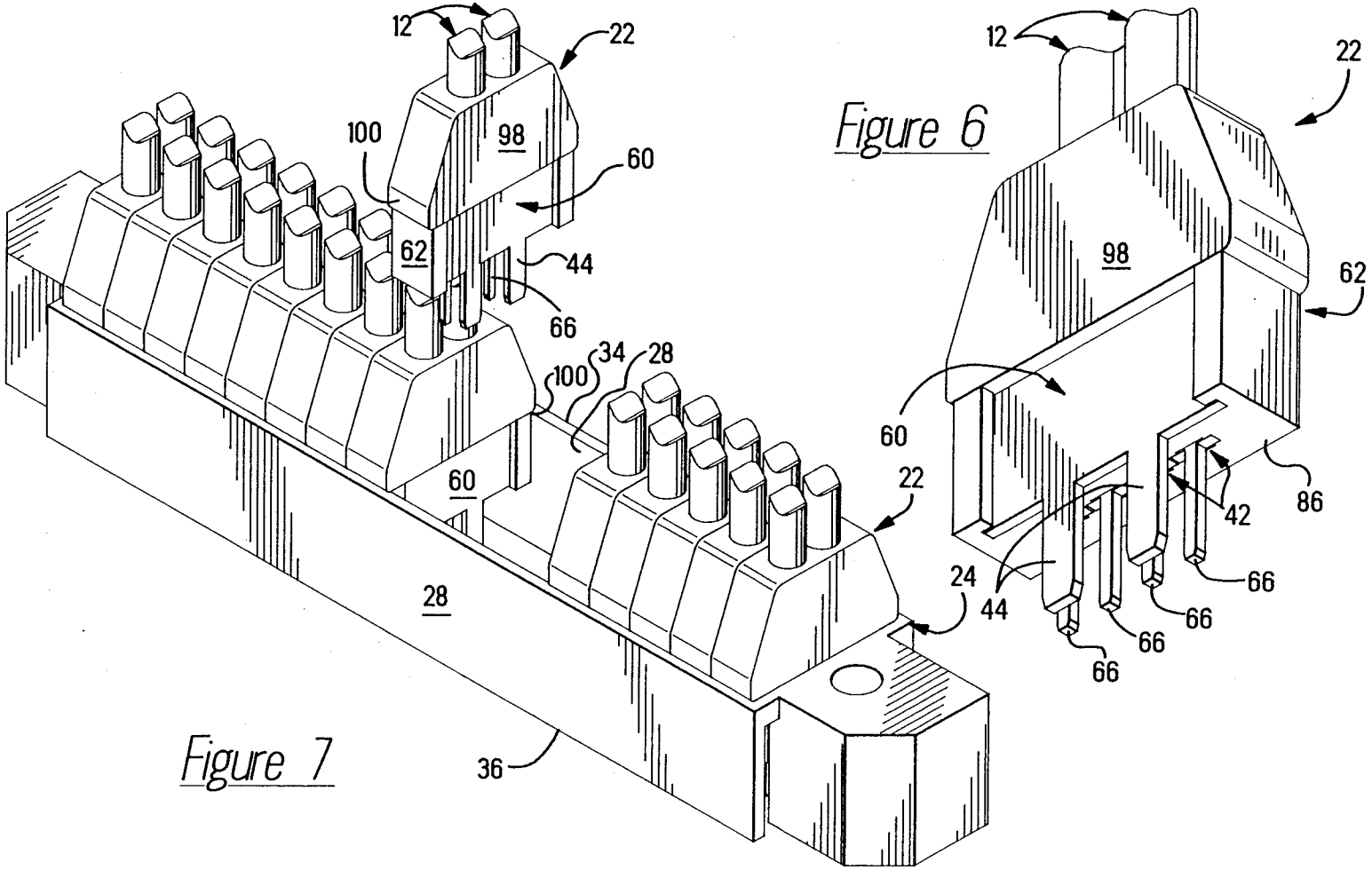
FIG. 6 is a perspective view of an assembled module.
FIG. 7 is a perspective view of a housing being loaded with modules to form a pin header.

FIG. 6 shows an assembled module 22 from a different angle. Note that ground blades 44 are spaced from the row of signal pins 42 but face the spaces between the outer and inner pins 42.

As shown in FIG. 7, modules 22 are loaded into housing 24 from rear face 34 so that posts 66 on pins 42 and blades 44 on elements 60 are accessible from front face 36. Modules 22 are frictionally retained in housing 24 by side walls 28 pressing in against sides 100 of hoods 98. As shown, modules 22 are positioned in side by side relation so that ground elements 60 are located between adjacent rows of signal pins 42.

The embodiment of the present invention described hereinabove includes for example, tabs 64 and 78 on pins 42, elements 60 respectively, for having signal wires 16 and ground wires 18 welded thereto. Alternatively, other wire terminating devices could be substituted for tabs 64,78; e.g., crimping wire barrels, solder tabs and so forth. Similarly posts 66 and blades 44 may be replaced by other mating devices well known to those skilled in the art. Other components also can be replaced by equivalent components.

As can be discerned, a cable assembly has been disclosed which includes twin axial conductors terminated to modules having signal pins and also ground elements to maintain signal integrity. Each module is provided with a row of signal pins and a ground plate spanning the row to isolate the signal pins from signal pins in adjacent modules. The modules are retained in a housing to form a pin header which mates with a receptacle mounted on a circuit board or electronic device; e.g., a computer main frame or a PC.

I claim:

1. A cable assembly comprising:

a cable containing a plurality of conductors with each conductor containing a signal wire and a ground wire;

a plurality of insulative modules attached to said conductors at each end of said cable, each module having a pair of signal pins disposed in adjacent passages extending through the module and having a tab extending outwardly from one end to which are electrically attached the signal wires of a pair of conductors, said each module further having a ground plate disposed in a recess on one side thereof, said plate being parallel to, spaced from and extending beyond the passages on each side and further having tabs at each corner of one end to which the ground wires of said pair of conductors are electrically attached; and a housing at each end of said cable in which said modules are disposed in side by side relation whereby respective said ground plates are positioned between signal pins in adjacent modules.

* * * * *